US005600973A

United States Patent [19]

Drisaldi

[11] Patent Number: 5,600,973

[45] Date of Patent: Feb. 11, 1997

[54] PROCESS AND MACHINE FOR MANUFACTURING ELASTIC BANDS AS WELL AS BANDS THUS OBTAINED

[76] Inventor: Giuseppe Drisaldi, Via Forgaria, 11-Novara, Italy

[21] Appl. No.: 586,732

[22] Filed: Jan. 18, 1996

[30] Foreign Application Priority Data

Jul. 30, 1993 [IT] Italy ..... MI93A1757

[51] Int. Cl.[6] ..... D04B 15/50

[52] U.S. Cl. ..... 66/9 A; 66/132 R

[58] Field of Search ..... 66/8, 9 A, 132 R, 66/125 R, 131, 146

[56] References Cited

U.S. PATENT DOCUMENTS

| | | | |
|---|---|---|---|
| 1,755,809 | 4/1930 | Buraux et al. | 66/9 A |
| 1,814,324 | 7/1931 | Meiwald | 66/9 A |
| 2,568,806 | 9/1951 | Henning | 66/9 A |
| 3,418,830 | 12/1968 | Nestel | 66/9 A X |
| 3,590,601 | 7/1971 | Sugiura . | |
| 4,977,758 | 12/1990 | Muir | 66/132 R X |
| 5,050,405 | 9/1991 | Jacobsson | 66/132 R |
| 5,520,018 | 5/1996 | Wood | 66/9 A |

FOREIGN PATENT DOCUMENTS

| | | | |
|---|---|---|---|
| 72 21850 | 2/1973 | France . | |
| 2926773 | 1/1980 | Germany | 66/9 A |
| 3002311A1 | 7/1981 | Germany . | |
| 336861 | 10/1930 | United Kingdom | 66/9 A |

*Primary Examiner*—John J. Calvert

*Attorney, Agent, or Firm*—Panitch Schwarze Jacobs & Nadel, P.C.

[57] ABSTRACT

Process and machine for manufacturing elastic bands with small diameter tubular fabric knitting machines of the single-feed type with fixed needle cylinder and revolving cam drum, wherein a bobbin holder of an elastic thread is autonomously supported above the needle cylinder and coaxial with respect to the needle cylinder. The revolving drum has a taking arm which guides the elastic thread and the inelastic thread without mutual contact up to the immediate vicinity of the needle cylinder. A sensor detecting the diameter change of the elastic thread cylindrical bobbin is operatively connected to a driving device with regulated speed control which keeps constant the elastic thread feed. The tubular bands obtained are knitted bands with at least one inelastic thread and at least one bare elastic thread.

10 Claims, 4 Drawing Sheets

PROCESS AND MACHINE FOR MANUFACTURING ELASTIC BANDS AS WELL AS BANDS THUS OBTAINED

The present invention concerns a process and a machine for manufacturing tubular knitted elastic bands, as well as the thus obtained bands.

The elastic bands referred to in the invention are generally used in the clothing industry and in particular in the field of underwear and corsetry. These elastic bands may be produced with different machines, e.g. with ribbon looms with 90° warp/weft crossing of weaving kind, with crochet looms and with braiding machines. These bands have a different aesthetic appearance according to the manufacturing machine. It is also known that in the mentioned fields of use high-quality elastic bands are requested, with different elastic properties and always new motifs.

The object of the invention is to provide a process and a machine of the type where the machine has a fixed needle cylinder and revolving cam drum which forms a single stitch course each revolution and where there are inelastic and elastic yarns fed through a single yarn feed to the needles. The feed of the elastic yarn is constant. A further object of the invention is to give to the band, at least on one side, ornamental patterns and motifs without limiting the machine productivity and giving a compact double-layer structure to the tubular band.

As far as the process is concerned, the object is achieved according to the invention through a process which is characterized in that at least one inelastic thread and at least one bare elastic thread are fed simultaneously and independently of each other to the machine head, revolving at a constant speed, and in that the feed of elastic thread is constant and given by the length of elastic thread not under tension as wound on its bobbin and picked up by a thread-taking arm, at each revolution of the machine head, which constant feed is achievable through an instantaneous angular velocity of the bobbin $V_{Rist}$ according to the formula:

$$V_{Rist}=V_T \pm V_T*(A_{FE}/C_{RFE})$$

wherein:

$V_{Rist}$ is the instantaneous angular velocity of the elastic thread bobbin, $V_T$ is the constant angular velocity of the machine head, $A_{FE}$ is the feed of elastic thread (not under tension as wound on its bobbin) to be fed to the needle cylinder at each revolution of the machine head, $C_{RFE}$ is the instantaneous circumference of the elastic thread cylindrical bobbin.

Lasting, smooth, soft and glossy bands are obtained thanks to the fact that, after the formation of the tubular band, a thermo-finishing step with band flattening and stretching takes place.

Elastic bands are obtained with at least one worked surface according to motifs which can be freely chosen thanks to the fact that a final step of pressing and hot embossing of the band is provided.

As far as the machine is concerned, the object is achieved, according to the invention, thanks to the fact that a machine is characterized in that a bobbin holder is provided housing at least an elastic thread cylindrical bobbin which can be driven at a regulated speed, in that the revolving drum of the machine head has a thread-taking arm, and in that the arm receives the elastic thread at an end near the elastic thread bobbin and has the thread guide for the inelastic thread and an outlet thread guide for the elastic thread at an end near the needle cylinder.

A compact machine structure and a precise regulation of the elastic thread feed are obtained thanks to the fact that the bobbin holder for the elastic thread cylindrical bobbin is supported by means of a hollow shaft on the machine frame above the needle cylinder and coaxial thereto, and to the fact that a sensor is provided continuously detecting the diameter of the elastic thread cylindrical bobbin and operatively connected to a driving device with regulated control of the bobbin-holder revolving speed for the elastic thread cylindrical bobbin.

The elastic properties of the band can be changed by varying the elastic thread feed, thanks to the fact that the machine includes a driving device with a driving motor which can be set at a constant speed and a common driving belt between the machine head and two speed variators connected to each other and to the elastic thread bobbin holder, to the fact that the first speed variator can be regulated through an own servocontrol motor by an electronic unit which can be set, and to the fact that the elastic thread feed can be set and kept constant by means of the electronic unit.

Lasting, smooth, soft-touch and glossy bands can be obtained thanks to the fact that a tubular band thermo-finishing group is provided downstream the machine head, that the thermo-finishing group consists of two opposing heatable flattening plates, that a plate is fixedly supported and the other plate is supported on a mobile arm and pushed against the first plate by a spring housed in an adjustable way in the mobile arm.

Flattened bands are obtained having the desired band surface finishing thanks to the fact that a group for pressing and embossing the manufactured band is provided on the outlet side of the machine, that the pressing and embossing group consists of at least a pair of pressing and embossing cylinders, and that at least one cylinder of the cylinder pair is provided with an annular embossing cliché or molding surface is heatable and can be driven into rotation.

The main advantage achieved by the invention is that by means of the proposed machine multi-thread knitted tubular elastic bands with very compact and perfectly uniform stitches can be produced. Yet another advantage should be seen in that a finishing pattern or motif at will can be produced on at least one side of the flattened band, and this without reducing in any way the machine productivity. Furthermore, inelastic bands too can be produced.

A machine according to the invention for manufacturing elastic bands according to the invention is schematically illustrated in the drawing in a preferred embodiment and is described in greater detail hereafter referring to the annexed drawings wherein.

Figure 1:
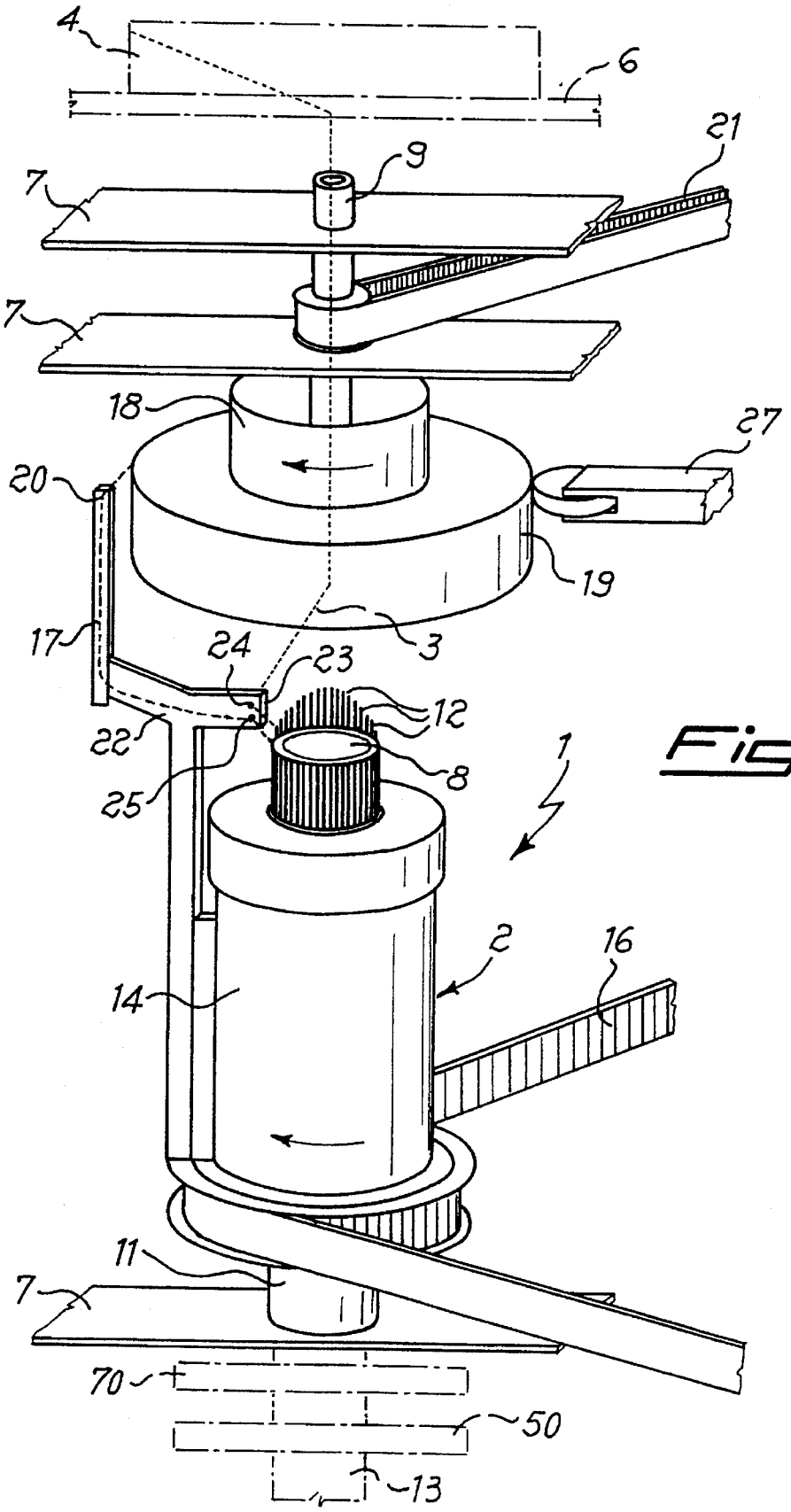
FIG. 1 is a partial perspective view of the machine.

Reference is made at first to FIG. 1, wherein there are indicated the substantial parts for the understanding of the machine structure and of the process according to the invention. In the illustrated preferred embodiment, the machine for manufacturing elastic bands is globally indicated by 1 and it includes a machine head 2 of a small diameter tubular fabric knitting machine known per se, with a fixed needle cylinder 8 and a revolving cam drum 14. The machine head is of the thread single-feed type and it allows the formation of a single stitch course at each revolution of drum 14. These known machines are fed with a single inelastic thread 3, generally of synthetic material. The term inelastic thread or thread means any low-stretch or negligible-stretch thread, of natural fibers or of artificial or synthetic material. The inelastic thread bobbin is indicated by 4 and it is supported on a bobbin holder 6 integral with the machine frame 7. The bobbin holder 6 can support one or more bobbins 4. The inelastic thread 3 is fed to the needle cylinder 8 through a known feeding device, and a thread guide, not illustrated.

The needle cylinder 8 houses at the top a ring of vertically displaceable needles 12. The needle cylinder 8 in its base 11 is fixed to the machine frame 7 and it is made hollow for the passage of the manufactured tubular band 13. The external drum 14 houses the two cams, not illustrated, necessary for the up-down movement of needles 12. The revolving drum 14 is connected, through a drive 16, to a constant-speed driving device, not shown. To this point, the tubular fabric knitting machine is known. Inelastic tubular bands can be produced with this machine. Here intervenes the invention according to which an additional feeding of at least an elastic thread 17 is provided in addition to the insertion of at least an inelastic thread. The elastic thread 17 is preferably a bare elastic thread, e.g. of elastomer, latex or any suitable material.

To this purpose, as it can be seen in FIG. 1, machine 1 includes a bobbin holder 18 for at least a cylindrical bobbin 19 of elastic thread 17 above the machine head 2. The bobbin holder is keyed onto a hollow shaft 9 which is rotatably supported on the machine frame 7 and whose axis is aligned with the axis of the needle cylinder 8.

The bobbin holder 18 is thus supported in a manner independent and separate from the machine head 2. The bobbin holder 18 can be set into rotation by means of a regulated speed drive, not shown in FIG. 1, through belt 21. The driving devices connected to the machine head 2 and to the bobbin holder 18, for example through belts 16 and 21, could be independent, in a way not illustrated. In a preferred embodiment, belts 16 and 21 are part of a regulated speed driving device, globally indicated by 30, shown in FIG. 2 and described hereafter.

According to the invention, a taking and guiding arm 22 for the two threads 3, 17 is fixed to the revolving drum 14. In the example, arm 22 is L-shaped with an upper end 20 which is about at mid-height of the elastic thread cylindrical bobbin 19 and at a certain distance from the bobbin. The elastic thread 17 runs from the upper end 20 to the arm end 23 near the needle cylinder 8 through suitable passages, not shown in detail.

The thread guide 24 is used to guide in a known way the inelastic thread 3 while the thread guide 25 is used as an outlet thread guide for the elastic thread 17.

Figure 2:
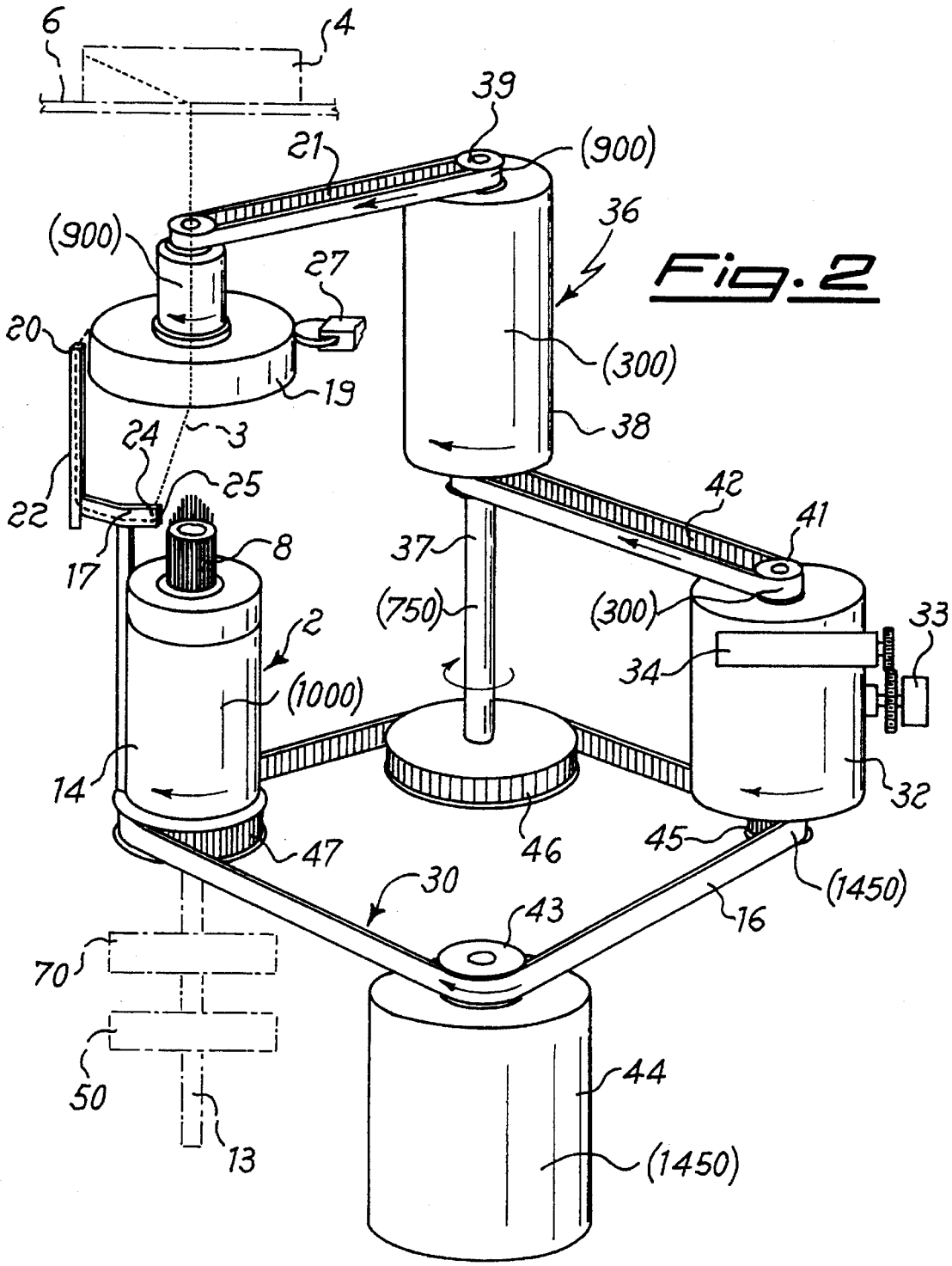
FIG. 2 is a perspective view of an embodiment of the machine driving device.

Numeral 27 indicates a sensor continuously detecting the value of the diameter of the elastic thread cylindrical bobbin 19 and operatively connected with the regulated speed driving device 30, FIG. 2. As it can be seen in FIG. 2, the driving device 30 includes a driving motor 44 which can be set at a predetermined constant speed. The motor 44 operatively connects through belt 16 the revolving drum 14 of the machine head 2 to the bobbin holder 18 of the cylindrical bobbin 19 of elastic thread 17 by means of the interposition of two speed variators in sequence. A first speed variator 32 is, for example, of a mechanical epicyclic type and includes a servocontrol motor 34, in addition to a manual control 33.

The second speed variator consists of a revolution differentiator 36 with an inlet shaft 37, a revolving box 38 and an outlet shaft with a pulley 39. The pulley 39 is connected to the bobbin holder 18 through belt 21. The revolving box 38 is connected to the outlet 41 of the motovariator 32 through a drive 42. As it can be seen in FIG. 2, the ring drive 16 simultaneously connects the outlet 43 of the driving motor 44 to the inlet 45 of the first speed variator 32, to the pulley 46 of the inlet shaft 37 of the speed differentiator 36 and to the pulley 47 of the revolving drum 14. All belts 16, 21 and 42 are such as to keep constant transmission ratios, for example internally toothed belts. Drive 16 is preferably controlled by an inverter.

The speeds in various points of the driving device 30 in a practical case of operation, and in a specific moment of the manufacturing of band 13, are indicated in brackets in FIG. 2, as an example, and are given in rev/min. Upon decrease of the diameter of bobbin 19, also the angular velocity of bobbin holder 18 will change, as explained hereafter.

Figure 3:
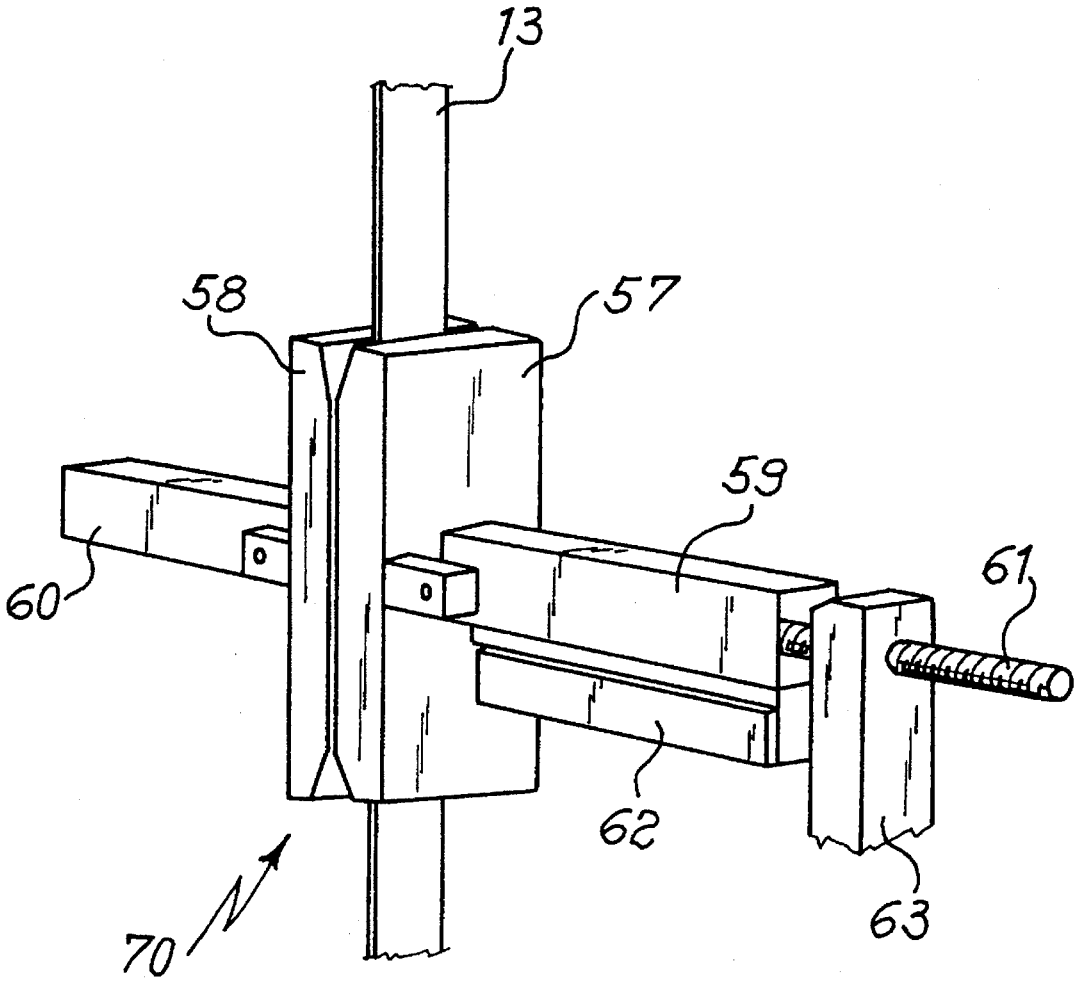
FIG. 3 is a perspective view of a detail of the band thermo-finishing group.

A thermo-finishing group 70 for band 13 is provided below the machine head 2, under the known band-tensioning rollers, not shown. As it can be seen in FIG. 3, the thermo-finishing group 70 consists of two opposing plates 57 and 58 through which band 13 runs. Plates 57 and 58 are heatable, for example electrically, in an adjustable way not illustrated. Plate 58 is supported on a fixed arm 60, integral with frame 7, whereas plate 57 is mounted on an arm 59 sliding on a fixed plate 62. A pushing spring, not illustrated, is housed inside the sliding arm 59. The compression of the spring can be adjusted by means of a threaded bar 61 housed in a bracket 63 integral with the machine.

Figure 4:
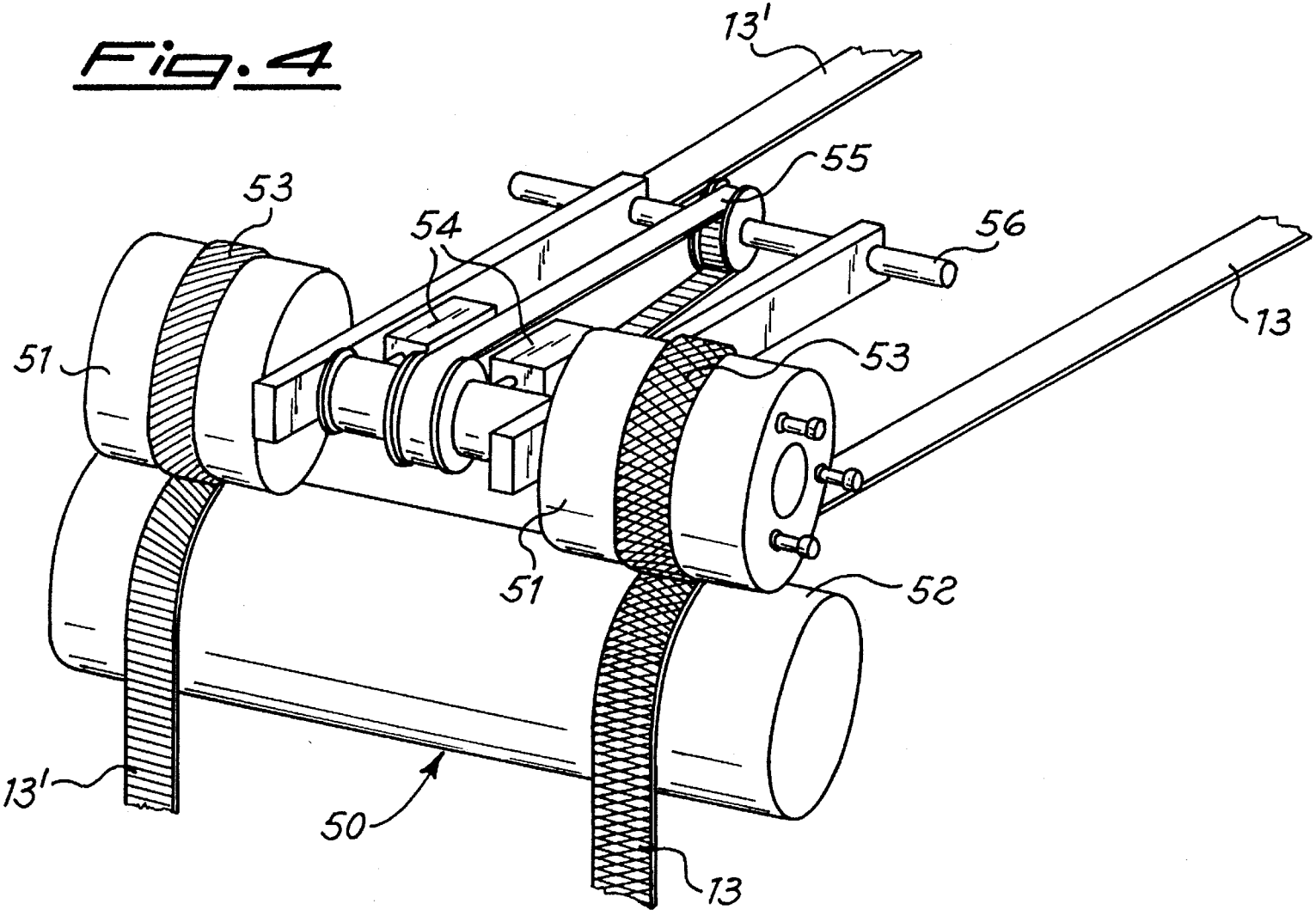
FIG. 4 is a perspective view of a detail of the band pressing and embossing group.

A pressing and embossing group 50 is preferably provided on the outlet side of machine 1 to carry out an embossing on at least one side of the flattened band 13. As it comes out more clearly from FIG. 4, group 50 consists of at least a pair of opposing cylinders 51 and 52, supported in mutual contact with the interposition of pushing springs, not illustrated. In order to achieve a lasting embossing and a pressing action on band 13, at least one cylinder, cylinder 51 in the example, is made heatable, is provided with an annular embossing cliché 53 and it can be driven into rotation. In the illustrated example, cylinder 51 is electrically heatable through commutator and brushes contacts indicated by 54. The rotation is achieved through a belt drive 55 whose driving shaft 56 is connected to driving means not shown in detail. In FIG. 4, group 50 is provided with a double pair of pressing and embossing cylinders to achieve the embossing of at least two elastic bands 13, 13' simultaneously produced by two heads in case the machine is provided with two or more heads. A plurality of interchangeable embossing clichés 53 with different embossing motifs can be provided as well. At least a further embossing cylinder can also be associated to a pair of embossing cylinders. In this way, a multi-stage embossing is obtained, wherein each embossing cylinder transfers its own pattern on the band.

The machine according to the invention operates in the following way: drum 14 of the machine head 2 revolves at a constant speed during the operation. The inelastic thread 3 is taken to the needle cylinder 8 through the hollow shaft 9 and the thread guide 24 on arm 22. The elastic thread 17 must be fed to the needle cylinder 8 with a constant predetermined feed or amount which consists of a fixed length of thread, not under tension as wound on bobbin 19, at each revolution of the revolving drum 14. In order to achieve this constant feed, the angular velocities of the machine head, i.e. of arm 22, and of bobbin holder 18 will have to be different. Therefore, the cylindrical bobbin 19 is revolved at a regulated speed and the upper end 20 of arm 22 revolves around it, at a constant speed, in the same direction and never touching it, like a "satellite".

The elastic thread 17 coming from bobbin 19 enters a thread guide at the upper end 20 of arm 22, runs along suitable passages in arm 22 and comes out from the thread guide 25 at end 23 to be taken to the needle cylinder 8. According to the invention, the two threads 3 and 17 are looped together on the needle cylinder 8 and they must never cross or be superimposed in their paths from the respective bobbins to the needle cylinder. It is further noted that the elastic thread 17 between bobbin 19 and the upper end 20 of arm 22 is practically taken from the cylindrical bobbin 19 in the desired amount thanks to the mentioned difference in the angular velocities of the revolving drum 14 and the cylindrical bobbin 19.

In order to achieve the required constant feed of the elastic thread, the revolving speed of bobbin 19 is continuously controlled with reference to the constant speed of the revolving drum 14. More precisely, the angular revolving speed of bobbin 19 will have to satisfy in every moment the formula:

$$V_{Rist}=V_T \pm V_T*(A_{FE}/C_{RFE})$$

In practice, in most cases and in the illustrated conditions wherein the machine head 2 and bobbin 19 revolve in the same direction (clockwise in FIG. 1) and bobbin 19 is positioned so that the unwinding of thread 17 takes place in the same direction, the minus sign is valid, i.e. the angular velocity of the elastic thread cylindrical bobbin 19 will have to be in every moment equal to the angular velocity of the machine head 2 reduced by the product obtained from said angular velocity by the portion of external circumference of bobbin 19 corresponding to the desired amount of elastic thread, divided by the instantaneous external circumference of bobbin 19. Considering the actual dimensions, the elastic thread feed and the bobbin circumference will advantageously be indicated in cm. In other cases, though the machine head 2 and bobbin 19 revolve in the same direction, bobbin 19 is positioned so that the unwinding of thread 17 takes place in the opposite direction, so that the plus sign is valid. The regulation of the bobbin holder angular velocity is achieved by means of an electronic unit, not shown in detail and illustrated here, which can be set and keeps constant the feed of the elastic thread 17 according to three parameters, namely the amount of elastic thread which is intended to be taken to the needle cylinder at each revolution of the revolving drum, the decrease in the diameter of the cylindrical bobbin 19 during the operation, and the revolving speed of the revolving drum.

In practice, after having set through an inverter a constant speed of motor 44, and therefore of the revolving drum 14 of the machine head 2, the value of the elastic thread feed, i.e. the length in cm of elastic thread, not under tension, to be fed to the needle cylinder 8 at each revolution of the revolving drum 14, is set on the electronic unit by means of a keyboard, or another device. The instantaneous angular revolving speed of bobbin 19 will be determined by processing these two data and the data sent to the electronic unit by feeler 27. This velocity will be given to the bobbin holder 18 through the intervention of the servocontrol 34 on the mechanical epicyclic variator 32 and the subsequent differentiator 36.

The speed differentiator 36 operates as follows: when the external box 38 is still, pulley 39 always revolves with the same angular velocity of the revolving drum 14 because a variator located between the inlet shaft 37 and pulley 39 takes the velocity from 750 to 1000 rev/min. When the external box 38 revolves under the effect of the motion transmitted by variator 32, there is a reduction of the outlet speed equal to a number of revolutions which corresponds to the number of revolutions of box 38 divided by, e.g. in the considered example, the coefficient 3. For example, if the machine head 2, as well as its arm 22, revolves at 1000 rev/min and the external box 38 revolves at 300 rev/min, pulley 39 will have a speed of 1000–300/3=900 rev/min. A greater fineness of regulation of the speed of bobbin 19 is achieved by means of the revolution differentiator 36 because the latter acts on the relative velocity between bobbin 19 and the revolving drum 14 so that a given percent error is smaller (as absolute value) than the same error applied to the bobbin absolute velocity. However, differentiator 36 could also be omitted, in fact it would certainly be possible to directly control the elastic thread bobbin holder 18 by means of the mechanical epicyclic variator 32. The scope of the invention also includes independent driving devices for the machine head 2 and the elastic thread bobbin holder 18, for example by providing a motor which can be set at a constant speed for driving the machine head and a variable speed motor for driving the elastic thread bobbin holder. These motors are known per se and are not described in greater detail.

It is noted that sensor 27, known per se, will be arranged at the upper edge of the elastic thread cylindrical bobbin 19 so as not to collide with the revolving arm 22. After having been manufactured, the multi-thread knitted tubular band, with at least one inelastic thread and at least one elastic thread according to the invention, is preferably subjected at first to a thermo-finishing in device 70. The thermo-finishing will dimensionally stabilize band 13 as far as both its height and stretching degree are concerned. The degree of stabilization can be adjusted by acting on the temperature of plates 57, 58 and/or on the gripping pressure by acting on the threaded bar 61 to change the elastic pre-load of plate 57.

A pattern as provided by the cliché or molding surface is impressed on at least one side of the elastic band 13 by means of the pressing and embossing group 50.

I claim:

1. A process for manufacturing elastic bands with small diameter tubular fabric knitting machines, of the single-feed type, with a machine head having a fixed needle cylinder and revolving cam drum, with formation of a single stitch course at each revolution of the machine head, comprising simultaneously and independently feeding at least an inelastic thread and at least an elastic thread from separate bobbins to the machine head, which is revolving at a constant speed, providing through an instantaneous angular velocity of the bobbin $V_{Rist}$ according to the formula:

$$V_{Rist}=V_T \pm V_T*(A_{FE}/C_{RFE})$$

wherein:

$V_{Rist}$ is the instantaneous angular velocity of the elastic thread bobbin, $V_T$ is the constant angular velocity of the machine head, $A_{FE}$ is the feed of elastic thread, wound tension less on the bobbin to be fed to the needle cylinder at each revolution of the machine head, $C_{RFE}$ is and instantaneous circumference of the elastic thread cylindrical bobbin feeding the elastic yarn at a constant rate given by the circumferential length of the yarn at each revolution according to the instantaneous angular velocity of the bobbin.

2. The process, according to claim 1, further comprising band flattening and stretching after formation using the tubular band, a thermo-finishing stage.

3. The process, according to claim 1, further comprising providing a final band pressing and embossing stage.

4. A small diameter tubular fabric knitting machine for manufacturing elastic bands the machine comprising a machine head (2) of the single feed type with formation of a single stitch course at each revolution, including a hollow needle cylinder (8) integral with the machine frame (7), and an external revolving cam drum (14), a bobbin holder (6), arranged upstream the machine head (2), for housing at least one inelastic thread bobbin (4), and a feeder of the inelastic thread to the machine head (2) and a thread guide (24) in the area of the needle cylinder, further comprising a bobbin holder (18) for housing at least a cylindrical bobbin (19) of elastic thread (17) to be driven (21) at a regulated speed, wherein the revolving drum (14) of the machine head (2) has an arm (22) for removing and receiving the elastic yarn from the elastic yarn bobbin (17) at an end (20) near the bobbin (19) and which has the thread guide (24) for the inelastic thread (3) and an outlet thread guide (25) for the elastic thread (17) at an end (23) near the needle cylinder (8).

5. The machine according to claim 4, characterized in that the bobbin holder (18) for the bobbin (19) of the elastic thread (17) is supported by a hollow shaft (9) on the frame (7) of the machine (1) above the needle cylinder (8) and coaxial thereto, and in that a sensor (27) is provided continuously detecting a diameter of the cylindrical bobbin (19) of the elastic thread (17) and operatively connected to a drive with regulated control of the revolving speed of the bobbin holder (18) for the cylindrical bobbin (19) of the elastic thread (17).

6. The machine according to claim 4, further comprising a driving device (30) with an electric motor (44) having settable constant speed, two speed variators, a common driving belt (16) between the machine head (2) and the two speed variators (32, 36) which are connected to each other (42, 21) and to the bobbin holder (18) of the elastic thread (17), wherein a first of the speed variators (32) is regulated through an electronic control lable servocontrol motor (34), and wherein the feed of the elastic thread (17) can be set and kept constant by means of the electronic controllable motor.

7. The machine according to claim 6, further comprising the second speed variator (36) consists of a revolution differentiator with an inlet shaft (37), a revolving box (38) and an outlet shaft with a pulley (39) connected to the bobbin holder (18), said pulley (39) rotating with the velocity of the cam drum (14) reduced by a number of revolutions equal to the number of revolutions of box (38), driven by the first speed variator (32), divided by a selected coefficient.

8. The machine according to claim 4, further comprising a thermo-finishing group (70) for the tubular band (13) provided downstream the machine head (2), wherein the thermo-finishing group (70) consists of two opposing heatable flattening plates (57, 58), one of the plates (58) is fixedly supported and the other plate (57) is supported on a mobile arm which is pushed by an adjustable spring housed in (61) in the mobile arm.

9. The machine according to claim 4, further comprising a group (50) for pressing and embossing the manufactured band (13) provided on the outlet side, wherein the pressing and embossing group (50) consists of at least one pair of pressing and embossing cylinders (51, 52), at least one cylinder (51) of the cylinder pair is provided with an annular embossing surface (53), is heatable (54) is rotatable (55, 56).

10. Elastic bands comprising tubular knitted bands knitted with at least one inelastic yarn and at least one elastic yarn, which bands are flattened and which have at least one embossed side.

* * * * *